US012636557B2

(12) United States Patent
Lee

(10) Patent No.: US 12,636,557 B2
(45) Date of Patent: May 26, 2026

(54) LIGHTWEIGHT PADDLE CAPABLE OF IMPROVING SURFACE FLATNESS

(71) Applicant: Feng-Yu Lee, Taichung City (TW)

(72) Inventor: Feng-Yu Lee, Taichung City (TW)

( * ) Notice: Subject to any disclaimer, the term of this patent is extended or adjusted under 35 U.S.C. 154(b) by 774 days.

(21) Appl. No.: 18/097,495

(22) Filed: Jan. 17, 2023

(65) Prior Publication Data

US 2023/0149784 A1 May 18, 2023

Related U.S. Application Data

(63) Continuation-in-part of application No. 17/306,958, filed on May 4, 2021, now abandoned.

(51) Int. Cl.
*A63B 59/42* (2015.01)
*A63B 102/08* (2015.01)

(52) U.S. Cl.
CPC ..... *A63B 59/42* (2015.10); *A63B 2102/08* (2015.10)

(58) Field of Classification Search
CPC . A63B 59/42; A63B 2102/08; A63B 2209/00; A63B 60/40; A63B 60/54
See application file for complete search history.

(56) References Cited

U.S. PATENT DOCUMENTS 5,324,029 A * 6/1994 Kim ..... A63B 59/80 473/573
2016/0107053 A1* 4/2016 Pree ..... A63B 59/42 473/529
2024/0189679 A1* 6/2024 Davis ..... A63B 59/45
2025/0108274 A1* 4/2025 Se ..... A63B 59/42

FOREIGN PATENT DOCUMENTS

WO WO-2015192768 A1 * 12/2015 ..... A63B 59/40

OTHER PUBLICATIONS

Translation of WO-2015192768-A1 (Year: 2015).*

* cited by examiner

*Primary Examiner* — Jeffrey S Vanderveen
(74) *Attorney, Agent, or Firm* — Leong C. Lei

(57) ABSTRACT

A lightweight paddle capable of improving surface flatness includes a paddle body and a handle connected to the paddle body. The paddle body includes a substrate layer and two face plates. The substrate layer is formed with a groove. An elastic member is embedded in the groove. When the two face plates are glued to the substrate layer, the groove of the substrate layer provides a deformation space for the elastic member, which can make the outer surface of the elastic member flush with the surface of the substrate layer. The overall weight of the product can be reduced effectively, so the paddle is more lightweight.

4 Claims, 7 Drawing Sheets

LIGHTWEIGHT PADDLE CAPABLE OF IMPROVING SURFACE FLATNESS

CROSS REFERENCE TO RELATED APPLICATIONS

This is a continuation-in-part application of co-pending U.S. patent application Ser. No. 17/306,958, "PICKLEBALL PADDLE", filed on May 4, 2021.

BACKGROUND OF THE INVENTION

1. Field of the Invention

The present invention relates to sports goods, and more particularly to a lightweight paddle capable of improving surface flatness.

2. Description of the Prior Art

There are many types of rackets on the market, including beach bats, paddle tennis rackets, and pickleball paddles, all of which are very popular sports in Europe and the United States in recent years. In general, a conventional paddle includes a substrate layer and two face plates. Two surfaces of the substrate layer are overlaid with the two face plates, respectively. There will be a lot of vibration when the player swings the paddle to hit a ball. In order to reduce the transmission of vibration to the player's hand for the player to hit the ball more comfortably, an elastic member is provided between the face plates and the substrate layer. The elastic member may be made of ETPU, PU, EVA or ORTHOLITE. These materials are all foam materials, with the characteristics of lightness and elasticity. The elastic member is configured to absorb part of the reaction force when the ball impacts the face plate, reduce the speed of returning the ball, provide more deformation space, increase the contact area of the ball on the face plate, and appropriately extend the time the ball stays on the face plate. However, due to the characteristics and processing method of the foam material, it is difficult to obtain the rated accurate size and thickness due to the shrinkage of the material after molding. Therefore, the precise cutting of length and width is easier, while the precision of thickness is always a problem. Due to the characteristics of the foam material and the products obtained by the foaming process, it is difficult to keep the thickness of the elastic member consistent, such as uneven thickness or uneven surface. It is labor-intensive and time-consuming to go through secondary planning and cutting. If the entire elastic member with uneven thickness or uneven surface (having protrusions) is bonded between the substrate layer and the two face plates, it will cause the face plate of the paddle to tilt, dent or bulge easily to affect the effect of hitting a ball. Besides, the large area of the elastic member increases the overall weight of the paddle, which is not conducive to use. Therefore, it is necessary to improve the conventional paddle.

SUMMARY OF THE INVENTION

In view of the drawbacks of the prior art, the primary object of the present invention is to provide a lightweight paddle capable of improving surface flatness, which can effectively solve the problems that the existing paddle having an elastic member is heavy in weight and the surfaces of the face plates are not flat.

In order to achieve the above object, the present invention adopts the following technical solutions:

A lightweight paddle capable of improving surface flatness comprises a paddle body and a handle connected to the paddle body. The paddle body includes a substrate layer and two face plates. Two surfaces of the substrate layer are overlaid with the two face plates, respectively. The surfaces of the substrate layer are formed with a groove. An elastic member is embedded in the groove. When the two face plates are glued to the substrate layer, the outer surfaces of the elastic member are tightly attached to the inner surfaces of the face plates. At this time, the inner surfaces of the face plates press the elastic member that may have uneven outer surfaces, so that the elastic member is deformed to be fully embedded in the groove. The groove of the substrate layer provides a deformation space for the elastic member, which can make the outer surfaces of the elastic member flush with the surfaces of the substrate layer. The overall weight of the product can be reduced effectively, so the paddle is more lightweight. Besides, after the face plates are adhered to the substrate layer, there will be no inclination, depression or bulge on the surfaces of the face plates because the elastic member is uneven in thickness.

Compared with the prior art, the present invention has obvious advantages and beneficial effects. Specifically, it can be known from the above technical solutions:

The substrate layer has the groove. The elastic member is embedded in the groove. The substrate and the elastic member are attached to the inner surfaces of the face plates. The protrusion of the elastic member is pressed and deformed by the inner surface of the face plate for the elastic member to be fully embedded in the groove, replacing the traditional way of placing the whole elastic member with uneven thickness or uneven surface on the surface of the substrate layer. The overall weight of the product can be reduced effectively, so that the paddle is more lightweight. The groove provides a deformation space for the elastic member. After the face plates are adhered to the substrate layer, there will be no inclination, depression or bulge on the surfaces of the face plates because the elastic member is uneven in thickness. This improves the flatness of the surface of the product greatly. It is beneficial for the player to swing the paddle to hit a ball and enables the player to control the ball well.

DETAILED DESCRIPTION OF THE PREFERRED EMBODIMENTS

Figure 1:
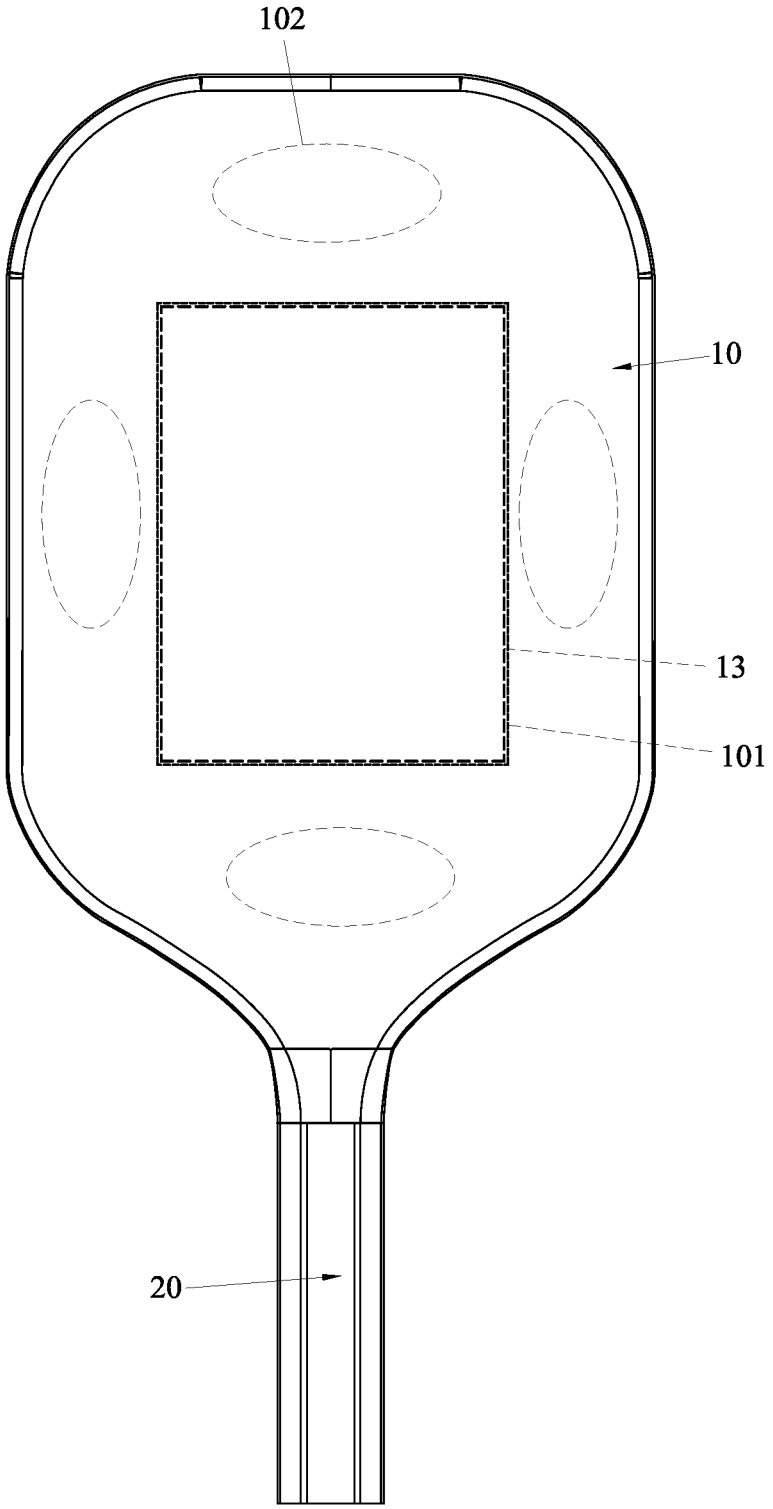
FIG. 1 is a front, perspective view in accordance with a first embodiment of the present invention.
Figure 2:
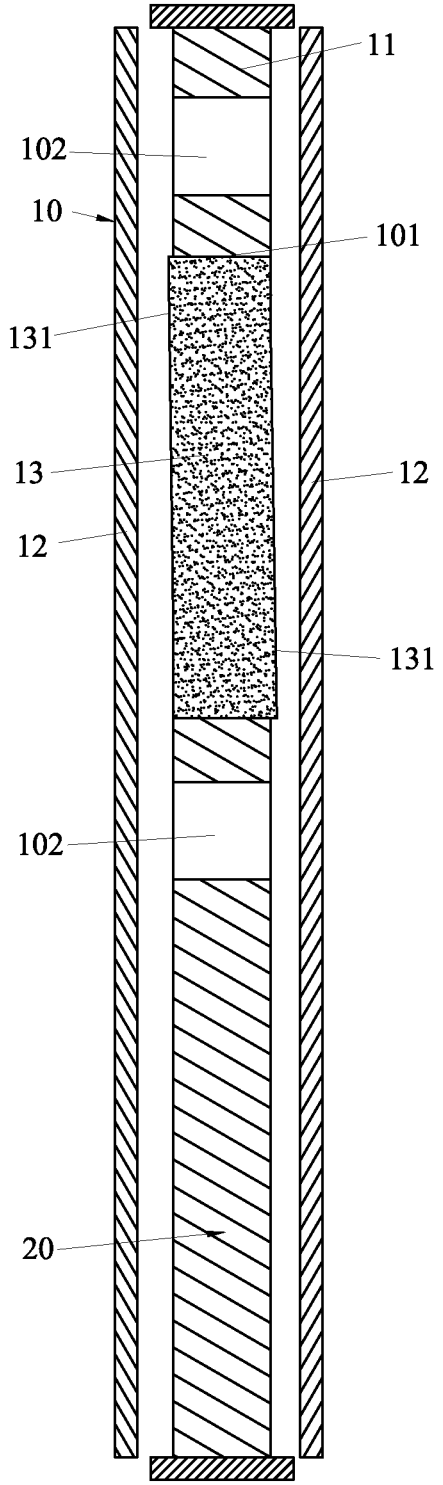
FIG. 2 is an exploded, cross-sectional view in accordance with the first embodiment of the present invention.
Figure 3:
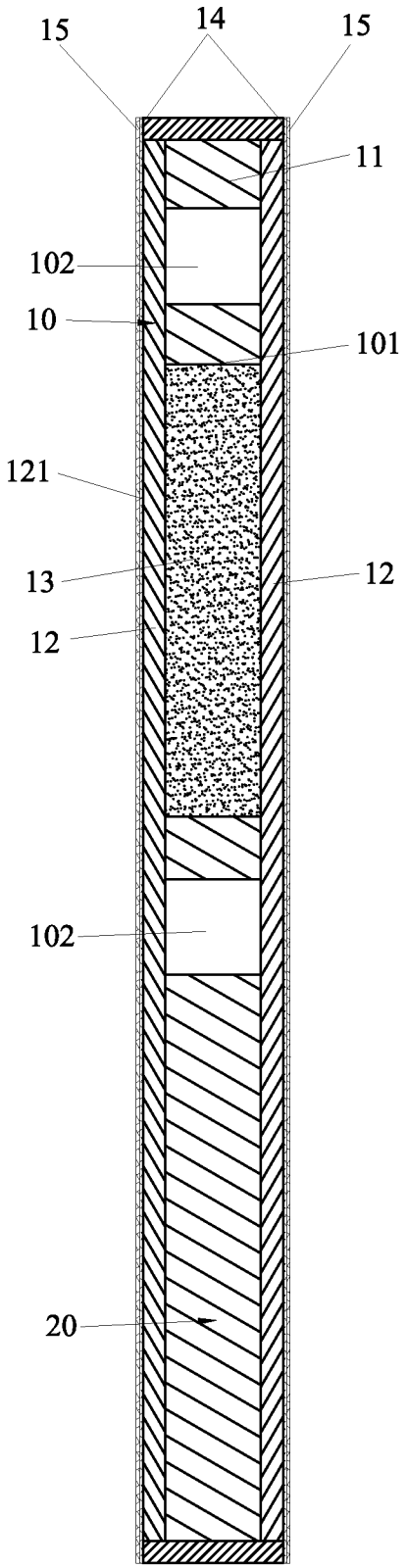
FIG. 3 is a cross-sectional view of FIG. 2 in an assembled state.

Referring to FIG. 1 through FIG. 3, the specific structure of a first embodiment of the present invention comprises a paddle body 10 and a handle 20 connected to the paddle body 10.

The paddle body 10 includes a substrate layer 11 and two face plates 12. Two surfaces of the substrate layer 11 are overlaid with the two face plates 12, respectively. The surfaces of the substrate layer 11 are formed with a groove 101. An elastic member 13 is embedded in the groove 101. The elastic member 13 may have a protrusion 131 extending out of the groove 101 due to its uneven thickness or uneven surface. The protrusion 131 will be pressed and deformed by the face plate 12. The outer surfaces of the elastic member 13 are attached to the inner surfaces of the face plates 12, respectively. The protrusion 131 of the elastic member 13 is pressed and deformed by the inner surface of the face plate 12 for the elastic member 13 to be fully embedded in the groove 101, so that the outer surface of the elastic member 13 is flush with the surface of the substrate layer 11. In this embodiment, the groove 101 passes through the two surfaces of the substrate layer 11. The elastic member 13 is embedded in the groove 101. The elastic member 13 has the protrusion 131 extending out of the groove 101. In this embodiment, the surface of the elastic member 13 is inclined to form the protrusion 131. After the face plate 12 is attached to the substrate layer 11, the protrusion 131 is deformed. Thus, the two outer surfaces of the elastic member 13 are attached to the inner surfaces of the two face plates 12, respectively. The two outer surfaces of the elastic member 13 are flush with the two surfaces of the substrate layer 11 respectively, so that the face plates are flat. The groove 101 is located at the center of the substrate layer 11, so the elastic member 13 is located in the sweet spot of the paddle for the user to swing the paddle to hit a ball better, thereby achieving a better rebound effect. The groove 101 is square, and the elastic member 13 is also square and cooperates with the groove 101 for better shock absorption. The groove 101 may be in other shapes, such as a circular shape, an irregular shape and so on, but not limited thereto.

The substrate layer 11 is formed with a plurality of perforations 02 for reducing the weight of the substrate layer 11. The plurality of perforations 102 are arranged around the periphery of the groove 101 to achieve the purpose of weight reduction, so that the overall weight of the product is reduced. The face plate 12 is a fiber plate, or may be a carbon fiber plate or a glass fiber plate, but not limited thereto. The face plate 12 is adhered to the surface of the substrate layer 11 by pressing, so that the assembly of the paddle is convenient and the structure is stable. A resin film 14 is attached to the outer surface of the face plate 12. The resin film 14 penetrates into the gaps of the face plate 12 by extruding via a release fabric 15. After the release fabric 15 is torn off, the outer surface of the face plate 12 forms a rough surface 121 for enhancing friction. The rough surface 121 can improve the friction of the surface of the paddle effectively when hitting a ball. In the process of using the paddle, the user can swing the paddle to control the ball well, so as to control the direction of hitting the ball effectively. It is convenient to use the paddle. In addition, the elastic member 13 is made of an ETPU (engineering thermoplastic polyurethane) material. The elastic member 13 is formed of multiple monomer particles molded and bonded, so that each of the monomer particles has an independent elastic structure, which can improve the rebound effect of the paddle effectively for hitting the ball back faster.

The handle 20 is integrally formed with the substrate layer 11 and the two face plates 12 and extends backward to form an integrated structure. The structure is more stable and reliable.

In production, the substrate layer 11 is first produced, and the two surfaces of the substrate layer 11 are perforated to form the groove 101. Next, the elastic member 13 is produced. The elastic member 13 is embedded in the groove 101. The protrusion 131 of the elastic member 13 may extend out of the groove 101. Then, the two face plates 12 are adhered to the two surfaces of the substrate layer 11 by gluing. The protrusion 131 of the elastic member 13 is pressed and deformed by the inner surface of the face plate 12 for the elastic member 13 to be fully embedded in the groove 101, so that the outer surface of the elastic member 13 is flush with the surface of the substrate layer 11. The inner surface of the face plate 12 is attached to the respective surfaces of the elastic member 13 and the substrate layer 11.

Figure 4:
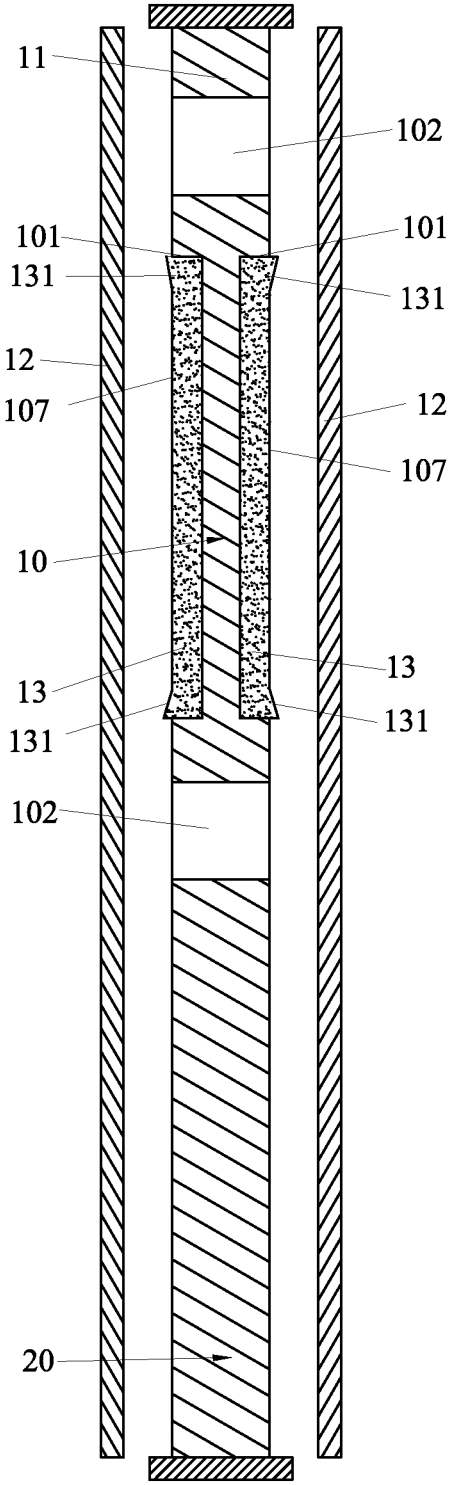
FIG. 4 is an exploded, cross-sectional view in accordance with a second embodiment of the present invention.
Figure 5:
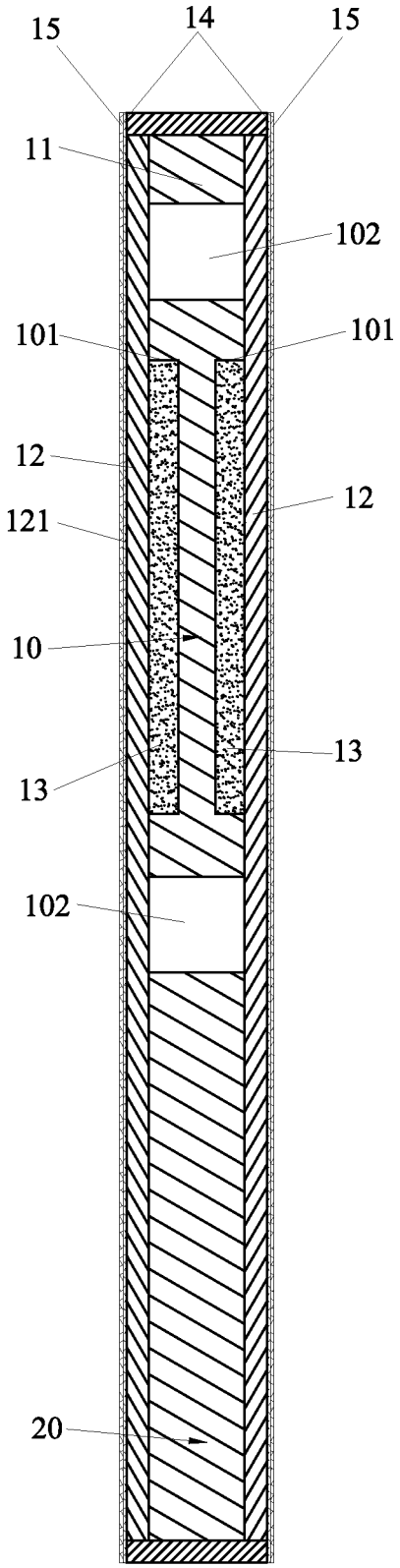
FIG. 5 is a cross-sectional view of FIG. 4 in an assembled state.

FIG. 4 and FIG. 5 illustrate the specific structure of a second embodiment of the present invention. The second embodiment is substantially similar to the first embodiment with the exceptions described hereinafter.

In this embodiment, each of the two surfaces of the substrate layer 11 is recessed to form the groove 101. The two grooves 101 of the two surfaces of the substrate layer 11 are spaced apart from each other. The elastic member 13 is embedded in each of the two grooves 101. The surface of the elastic member 13 may be uneven in thickness. The two ends of the elastic member 13 each have the protrusion 131. The surface of the elastic member 13 may be concave and uneven like the first embodiment, but not limited thereto. The protrusions 131 of the elastic members 13 are pressed and deformed by the inner surfaces of the corresponding face plates 12 for the elastic members 13 to be fully embedded in the corresponding grooves 101, so that the outer surfaces of the elastic members 13 are flush with the corresponding surfaces of the substrate layer 11. On the premise of ensuring the rebound effect, the amount of usage of the elastic member 13 is reduced.

In production, the substrate layer 11 is first produced, and the two surfaces of the substrate layer 11 are formed with the grooves 101. The two grooves 101 are spaced apart from each other. Next, two elastic members 13 are produced. The surfaces of the two elastic members 13 may be uneven in thickness. The two ends of the elastic member 13 each have the protrusion 131. The two elastic members 13 are embedded in the two grooves 101, respectively. Then, the protrusions 131 of the elastic members 13 are pressed and deformed by the inner surfaces of the two face plates 12 for the elastic members 13 to be fully embedded in the corresponding grooves 101, and the inner surfaces of the face plates 12 are adhered to the two surfaces the substrate layer 11.

Figure 6:
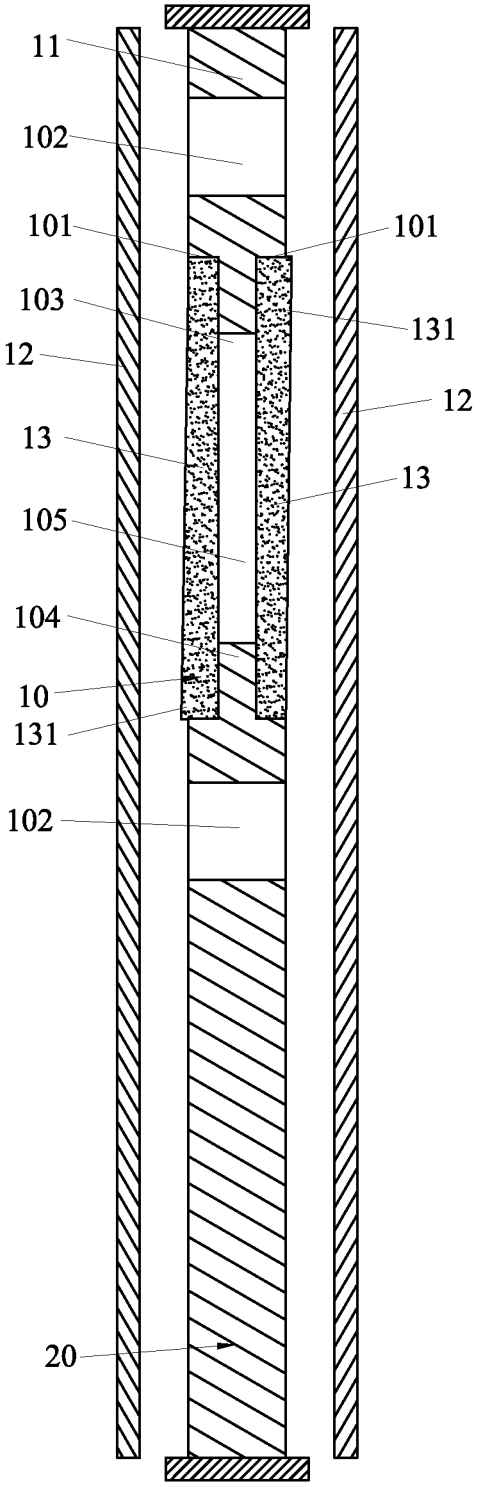
FIG. 6 is an exploded, cross-sectional view in accordance with a third embodiment of the present invention.
Figure 7:
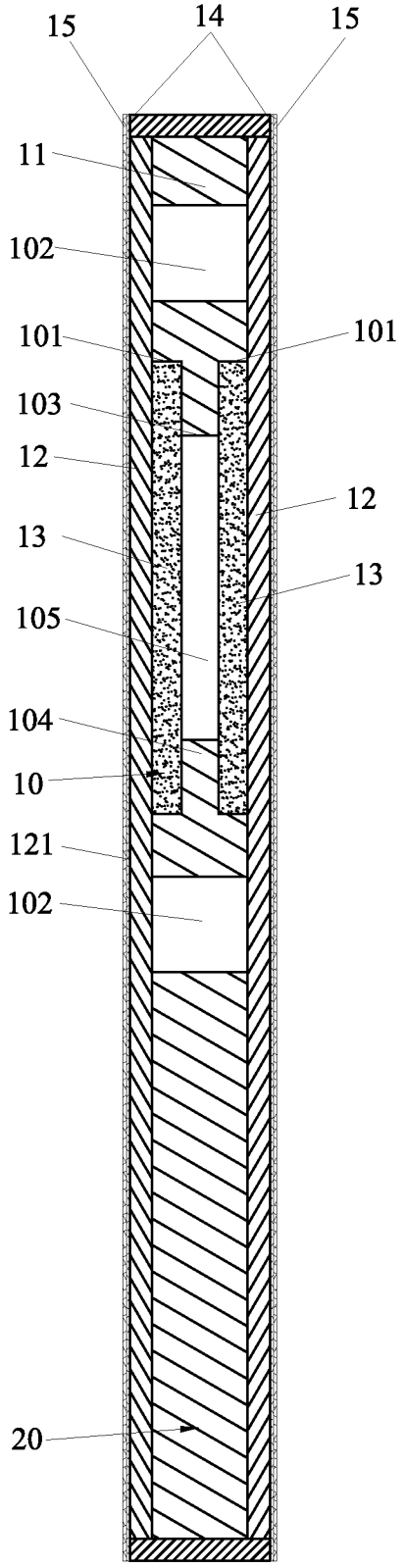
FIG. 7 is a cross-sectional view of FIG. 5 in an assembled state.

FIG. 6 and FIG. 7 illustrate the specific structure of a third embodiment of the present invention. The third embodiment is substantially similar to the second embodiment with the exceptions described hereinafter.

In this embodiment, the two grooves 101 communicate with each other, and a hollow space 103 is defined between the inner bottom surfaces of the two grooves 101. A support portion 104 is disposed on the edge of the hollow space 103. Two side surfaces of the support portion 104 respectively abut against the inner surfaces of the two elastic members 13, so that a deformation interspace 105 for enhancing elasticity is formed between the two elastic members 13.

When the paddle is to hit a ball, the elastic member 13 is compressed and deformed inwardly toward the deformation interspace 105. This provides a better shock absorption effect. Besides, it provides more deformation space for the elastic member 13, so that the elastic member 13 can be embedded in the groove 101 well. After the elastic member 13 is embedded in the groove 101, the outer surface of the face plate 12 is flat. The support portion 104 is ring-shaped, and may be in other shapes, but not limited thereto.

In production, the substrate layer 11 is first produced, and the two surfaces of the substrate layer 11 are formed with the grooves 101. The two grooves 101 communicate with each other, and a hollow space 103 is defined between the inner bottom surfaces of the two grooves 101. Next, two elastic members 13 are produced. The elastic member 13 may be inclined and uneven. The two ends of the elastic member 13 each have the protrusion 131. The two elastic members 13 are embedded in the two grooves 101, respectively. Then, the protrusions 131 of the elastic members 13 are pressed and deformed by the inner surfaces of the two face plates 12 for the elastic members 13 to be fully embedded in the grooves 101, and the inner surfaces of the face plates 12 are adhered to the two surfaces the substrate layer 11.

What is claimed is:

1. A lightweight paddle, comprising a paddle body and a handle connected to the paddle body; the paddle body including a substrate layer and two face plates; two surfaces of the substrate layer being overlaid with the two face plates, respectively; the surfaces of the substrate layer being formed with a groove, an elastic member being embedded in the groove, wherein the groove passes through the two surfaces of the substrate layer, the elastic member is embedded in the groove, two outer surfaces of the elastic member are attached to inner surfaces of the two face plates respectively, and the two outer surfaces of the elastic member are flush with the two surfaces of the substrate layer, respectively.

2. The lightweight paddle as claimed in claim 1, wherein each of the two surfaces of the substrate layer is recessed to form the groove, the two grooves of the two surfaces of the substrate layer are spaced apart from each other, the elastic member is embedded in each of the two grooves, and the elastic members are pressed and deformed by inner surfaces of the corresponding face plates for the elastic members to be fully embedded in the corresponding grooves, so that outer surfaces of the elastic members are flush with the corresponding surfaces of the substrate layer.

3. The lightweight paddle as claimed in claim 2, wherein the two grooves communicate with each other, a hollow space is defined between inner bottom surfaces of the two grooves, a support portion is disposed on an edge of the hollow space, and two side surfaces of the support portion respectively abut against inner surfaces of the two elastic members, so that a deformation interspace for enhancing elasticity is formed between the elastic members.

4. The lightweight paddle as claimed in claim 1, wherein the substrate layer is formed with a plurality of perforations for reducing the weight of the substrate layer, and the perforations are arranged around a periphery of the groove.

* * * * *